US011152744B2

(12) United States Patent
Ferderer

(10) Patent No.: US 11,152,744 B2
(45) Date of Patent: Oct. 19, 2021

(54) PLUG-TYPE CONNECTOR WITH LOCKING SYSTEM

(71) Applicant: HARTING ELECTRIC GMBH & CO. KG, Espelkamp (DE)

(72) Inventor: Albert Ferderer, Espelkamp (DE)

(73) Assignee: HARTING ELECTRIC GMBH & CO. KG

( * ) Notice: Subject to any disclaimer, the term of this patent is extended or adjusted under 35 U.S.C. 154(b) by 15 days.

(21) Appl. No.: 16/644,831

(22) PCT Filed: Sep. 24, 2018

(86) PCT No.: PCT/DE2018/100808
§ 371 (c)(1),
(2) Date: Mar. 5, 2020

(87) PCT Pub. No.: WO2019/063043
PCT Pub. Date: Apr. 4, 2019

(65) Prior Publication Data

US 2021/0075154 A1 Mar. 11, 2021

(30) Foreign Application Priority Data

Sep. 26, 2017 (DE) ..... 10 2017 122 245.6

(51) Int. Cl.
*H01R 13/622* (2006.01)
*H01R 13/52* (2006.01)

(52) U.S. Cl.
CPC ..... *H01R 13/622* (2013.01); *H01R 13/5219* (2013.01)

(58) Field of Classification Search
CPC ..... H01R 13/6277; H01R 13/622; H01R 13/5219
See application file for complete search history.

(56) References Cited

U.S. PATENT DOCUMENTS 5,195,904 A * 3/1993 Cyvoct ..... H01R 13/6277 439/349
6,267,612 B1 * 7/2001 Arcykiewicz ..... H01R 13/6275 439/253

(Continued)

FOREIGN PATENT DOCUMENTS

CN 1510795 7/2004 ..... H01R 13/639
CN 1288805 12/2006 ..... H01R 13/627

(Continued)

OTHER PUBLICATIONS

International Search Report and Written Opinion issued in PCT/DE2018/100808, dated Nov. 16, 2018, with English translations 18 pgs.
International Preliminary Report on Patentability issued in PCT/DE2018/100808, dated Mar. 31, 2020, English translation only, 8 pgs.

(Continued)

*Primary Examiner* — Tho D Ta
(74) *Attorney, Agent, or Firm* — Hayes Soloway P.C.

(57) ABSTRACT

Disclosed is a plug-type connector having a housing having at least one electrical contact element held therein, a locking ring and a union sleeve. The union sleeve and the locking ring are each arranged on the plug side of the plug-type connector, wherein the union sleeve can be moved axially and interacts with the locking ring. The union sleeve has a circumferential undercut and a circumferential groove adjoining the undercut, wherein the undercut is arranged on the union sleeve in the direction of the connection side and the groove is arranged on the union sleeve in tire direction of the plug side. The plug-type connector also has a seal, which serves simultaneously as a vibration damping system, a locking system and a protective system.

2 Claims, 2 Drawing Sheets

(56) References Cited

U.S. PATENT DOCUMENTS

| | | | | |
|---|---|---|---|---|
| 6,645,011 | B2 * | 11/2003 | Schneider | H01R 13/6277 439/578 |
| 6,709,289 | B2 | 3/2004 | Huber et al. | 439/578 |
| 7,351,088 | B1 * | 4/2008 | Qu | H01R 13/6277 439/352 |
| 7,785,129 | B2 * | 8/2010 | Chen | H01R 24/40 439/352 |
| 8,496,495 | B2 * | 7/2013 | Kari | H01R 13/6277 439/352 |
| 8,944,838 | B2 * | 2/2015 | Mulfinger | H01R 13/6277 439/352 |
| 9,478,911 | B2 | 10/2016 | Friesen | H01R 13/639 |
| 9,601,870 | B1 | 3/2017 | Ebisawa | H01R 9/05 |
| 2003/0153210 | A1 * | 8/2003 | Huber | H01R 13/6277 439/578 |
| 2004/0137778 | A1 * | 7/2004 | Mattheeuws | H01R 13/6277 439/352 |
| 2009/0275226 | A1 | 11/2009 | Chen | 439/271 |
| 2010/0029118 | A1 | 2/2010 | Yang et al. | 439/321 |
| 2020/0059050 | A1 * | 2/2020 | Meshram | H01R 13/6277 |

FOREIGN PATENT DOCUMENTS

| | | | |
|---|---|---|---|
| CN | 201117962 | 9/2008 | H01R 13/64 |
| CN | 201156616 | 11/2008 | H01R 13/52 |
| CN | 201266724 | 7/2009 | H01R 13/52 |
| CN | 104871374 | 8/2015 | H01R 13/627 |
| CN | 106654721 | 5/2017 | H01R 13/639 |
| CN | 107 196 122 | 9/2017 | H01R 13/52 |
| DE | 102 36 275 | 1/2004 | H01R 13/627 |
| DE | 10 2006 040 254 | 3/2008 | H01R 13/627 |
| DE | 10 2012 111 408 | 10/2013 | H01R 13/639 |
| EP | 0050575 | 10/1981 | H01R 13/627 |
| EP | 0 491 626 | 6/1992 | H01R 13/627 |
| EP | 0915534 | 5/1999 | H01R 13/627 |
| EP | 1 337 008 | 8/2003 | H01R 13/646 |

OTHER PUBLICATIONS

Office Action issued in Chinese application No. 201880062564.4 dated Oct. 23, 2020, with translation, 13 pgs.

* cited by examiner

PLUG-TYPE CONNECTOR WITH LOCKING SYSTEM

BACKGROUND OF THE INVENTION

The invention takes as its starting-point a plug-type connector with locking device.

Such a class of plug-type connectors may comprise both electrical and optical, pneumatic or hydraulic plug-type connectors. The plug-type connector is a round plug-type connector, in particular a so-called push/pull plug-type connector. The invention being presented can be applied to all generic plug-type connectors, in particular round plug-type connectors. Such plug-type connectors are needed in order, for instance, to couple pneumatic or optical lines with one another and/or to connect cables to one another electrically.

A durable, secure mechanical interlocking of plug-type connector and mating connector is just as important as a good linking of the conductors or cables to the internal contact elements. In addition to a mechanical connection of the plug-type connectors, a release of the connection must also be ensured. In this regard, the mechanical interlocking has to be released completely without destroying components of the latching mechanism or of the plug-type connectors. These procedures for contacting and disconnecting plug-type connectors have to be capable of being repeated many times without influencing the quality of the latching and the contacting of contact element and counter-contact element.

BRIEF DESCRIPTION OF THE PRIOR ART

The push/pull principle is presented in DE 10 2012 111 408 B3, amongst other documents. DE 10 2012 111 408 B3 presents a latching mechanism for plug-type connectors and mating connectors. In this case the latching mechanism is provided with two types of latching means: a primary latching element, which is suitable for latching the mating connector, and a secondary latching element, which is suitable for reciprocal latching with the primary latching element. In this case the secondary latching element latches the primary in the latched state of the latching mechanism, and the primary latching element latches the secondary in the unlatched state. By the mating connector being contacted, the mechanism is automatically latched, and it is unlatched by the secondary latching element—realized as an actuator—being actuated.

DE 102 36 275 B3 presents a latching device for two plug-type connectors capable of being joined together, wherein detent hooks on one of the plug-type connectors engage in detent recesses of the second plug-type connector in the course of joining the plug-type connectors together. By means of an actuator—here, a sliding sleeve and bevels molded thereon—the detent hooks can be raised and lifted out of the detent recesses, as a result of which a separation of the plug-type connectors is possible.

From DE 10 2006 040 254 A1 a plug-type connector—more precisely, a round plug-type connector—with two coupling parts is known, wherein detent elevations of the first coupling part engage in grooves of the second coupling part. In this case the detent elevations are pressed into the grooves by means of an actuator—more precisely, by means of an actuating slide. As a result of the actuating slide being withdrawn, the detent elevations can slide out of the grooves if a pull is appropriately applied to the two coupling parts.

From EP 1 337 008 A2 a plug-type connector is known that exhibits a latching ring, wherein the latching ring can be radially widened by means of an unlatching sleeve, and in this way a latching to a mating connector is released.

A disadvantageous aspect of the known plug-type connectors, however, is that they are interlocked via a deformation of the plug-type connector, or at least of an integral part of the plug-type connector. Furthermore, for each further desired function of the plug-type connector—for instance, a latching—a further component on the plug-type connector is necessary.

OBJECTS OF THE INVENTION

The object of the invention consists in proposing a plug-type connector with locking device, which enables a secure sealing and interlocking with, at the same time, simple handling and favorable manufacturability.

SUMMARY OF THE INVENTION

The invention relates to a plug-type connector with locking device, exhibiting a housing, with at least one electrical contact element received therein, a locking ring and a sleeve, in particular a union sleeve. The housing exhibits a plug-in side and a connection side, the union sleeve and the locking ring each being arranged on the plug-in side. The union sleeve is arranged so as to be axially mobile and interacts with the locking ring. The union sleeve exhibits, in addition, a circumferential undercut and a circumferential groove adjoining the undercut, the undercut being arranged on the union sleeve in the direction of the connection side, and the groove being arranged on the union sleeve in the direction of the plug-in side. The plug-type connector further exhibits a seal.

Plug-type connectors—in particular, round plug-type connectors and round plug-type connectors according to the push/pull principle—with locking device are known in the state of the art. In addition, there are some angular designs. The plug-type connector being presented herein is a round plug-type connector. Said connector exhibits a connection side and a plug-in side situated opposite the connection side. The connection side serves, for instance, for connecting an electrical conductor or an optical conductor or a pneumatic conductor. The plug-in side serves for contacting the plug-type connector with a suitable mating connector.

The plug-type connector exhibits a housing. In this case it is a question of a substantially cylindrical housing of a round plug-type connector. At least one contact element is received in the housing. The contact element may be an electrical or a pneumatic or an optical contact element. The conductor is attached to the at least one contact element from the connection side. In the direction of the plug-in side the at least one electrical contact element can be contacted with a corresponding contact element of the mating connector.

In addition, a locking ring is arranged in the housing on the plug-in side. The locking ring is an annular object. The locking ring serves for interlocking the plug-type connector and the mating connector.

A union sleeve is furthermore arranged on the housing. Said union sleeve is likewise located on the plug-in side, but in contrast to the locking ring it is arranged on the outside of the housing. In an alternative configuration, the union sleeve forms a part of the housing. The union sleeve has been configured in such a way that it is able to interact with the locking ring and deform the latter. For this purpose it exhibits an approximately cylindrical geometric body. The union sleeve preferably exhibits a detent-hook-like molded-on part. The detent-hook-like molded-on part points inward in the direction of the locking ring.

In an alternative configuration, the union sleeve does not exhibit a detent-hook-like molded-on part. In this configuration, the union sleeve can be inserted in any radial orientation.

In accordance with the invention, the union sleeve exhibits a circumferential undercut and a circumferential groove directly adjoining the undercut. The undercut is arranged in the direction of the connection side, and the groove is arranged in the direction of the plug-in side. In this way, the undercut and the nut constitute a common recess.

Furthermore, the union sleeve exhibits a seal. The seal serves, on the one hand, as protection against external environmental influences and, especially, the penetration of media into the plug-type connector, on the other hand as vibration-damping element and, in addition, as additional locking device for the union sleeve. In order to increase the degree of sealing further, the plug-type connector exhibits an annular seal in the region of the locking ring. By virtue of the two seals, it is possible to protect the plug-type connector in accordance with the desired IP protection classes. In this regard, objects are subdivided into corresponding protection classes, IP classes, with respect to their suitability for various environmental conditions. "IP" stands for "International Protection". It is a question of the degree of protection of the housing against contact, foreign bodies and water. The protection class of the plug-type connector can be advantageously increased by the sealing—the annular sealing, and that in the region of the union sleeve.

In an advantageous configuration, the undercut and the groove form a common region on the side of the union sleeve facing toward the housing. By virtue of the turning in the direction of the housing of the recess resulting from the undercut and the groove, said recess is already inherently protected to a limited extent against external influences. The combining of undercut and groove allows the union sleeve a limited space for movement, from the start of the undercut as far as the end of the groove. This movement space makes it possible that the union sleeve is capable of being optimally employed for the purpose of assembling and disassembling the plug-type connector. The movement space prevents an unintentional separation of union sleeve and housing, which in turn would render an assembly or a disassembly more difficult.

In a preferred configuration, the seal is an O-ring known from the prior art. O-rings are also known by the name "toric gasket" or "toric packing". They constitute a powerful and economical sealing element for a multitude of different applications for static and dynamic use. They consist primarily of elastomeric materials, by virtue of which the O-rings have a very broad range of application. They find use as primary sealing elements, as individual seals or as quality-assuring seals in automotive and mechanical engineering. O-rings preferably serve for radial static sealing as well as axial static sealing, but also for dynamic sealing.

In a particularly preferred configuration, the O-ring is arranged on the housing of the plug-type connector. Ideally in this case, said O-ring is arranged on the housing in a circumferential groove, so that it is fixed at a permanent position. As a result, the O-ring cannot twist or distort or tilt, which may result in damage to the O-ring and therefore in an abatement of the sealing function.

It is quite particularly advantageous if the union sleeve is displaceable over the O-ring in a sliding manner in the region of the circumferential groove and the circumferential undercut. The union sleeve consequently covers the O-ring and in this way prevents the influence of the external environment on the O-ring. By virtue of the configuration of the seal as an O-ring, in combination with the covering by the union sleeve, the plug-type connector is optimally sealed and realizes the desired degree of IP protection. The limited movement space of the union sleeve has been ideally combined with the O-ring at this point. As a result, the sealing of the plug-type connector is guaranteed.

In addition, the O-ring not only accomplishes the sealing but also assists a locking of the union sleeve by adhesion and friction in combination with the undercut. Furthermore, the O-ring enables a vibration-damping by damping of oscillations. For the vibration-damping, the O-ring has been designed in such a way that a deliberate friction is obtained between the O-ring and the union sleeve. By virtue of the vibration-damping, the sealing function of the O-ring is optimized and, in addition, a "rattling" of the union sleeve—as is the case with the push/pull and round plug-type connectors known from the prior art—is reduced or prohibited entirely. Furthermore, by virtue of the combination of O-ring and union sleeve, the fixing and locking of the union sleeve is guaranteed.

In a preferred configuration, the locking ring is split, by virtue of which the locking ring is compressible and dilatable. "Split" here means that the locking ring is not a complete ring but rather a ring with a slit—that is to say, it is an annulus segment. The slit has been designed to be small in relation to the overall size of the ring. The slit enables a compression and/or a widening—that is to say, a dilation or bending-open—in the circumferential direction of the locking ring under the influence of force. These two movements are necessary in order to connect the plug-type connector to a mating connector or to separate the plug-type connector from a mating connector.

In a particularly preferred configuration, the locking ring is compressible and dilatable by the axial movement of the union sleeve. This means that the union sleeve and the locking ring interact on the plug-in side of the plug-type connector. This interaction ensures an easy assembly and disassembly of the plug-type connector. The widening of the locking ring is effected by the axial movement of the union sleeve from the plug-in side in the direction of the connection side. This movement begins at the end of the groove facing toward the plug-in side, and ends in the region of the undercut. In the course of this movement, the detent-hook-shaped contour of the union sleeve pulls the locking ring apart and holds it in this position. A mating connector can now be assembled or disassembled, in the course of which the movement of the union sleeve does not have to be effected manually in the course of assembly but rather can be effected by the pressure in the course of the insertion of a mating connector. If the union sleeve moves, back into its original position, the locking ring is relieved again and returns to its original shape. In this position, a mating connector is interlocked and held securely.

This combination of housing, O-ring, union sleeve and locking ring consequently enables a reduction of the number of parts while simultaneously ensuring the desired and necessary functions. As a result, the plug-type connector is technically easier to realize and can be produced inexpensively. Through the use of standard components, in this configuration the plug-type connector can, in addition, be employed flexibly, because in this way it can be used for the most varied diameters and, for this, has only to be adapted in its dimensions but not in its structure.

BRIEF DESCRIPTION OF THE DRAWINGS

An embodiment of the invention is represented in the drawings and will be elucidated in more detail in the following. Shown are.

The figures contain partially simplified, schematic representations. In some cases, identical reference symbols are used for like but possibly not identical elements. Various views of like elements might have been scaled differently.

DETAILED DESCRIPTION OF THE INVENTION

Figure 1:
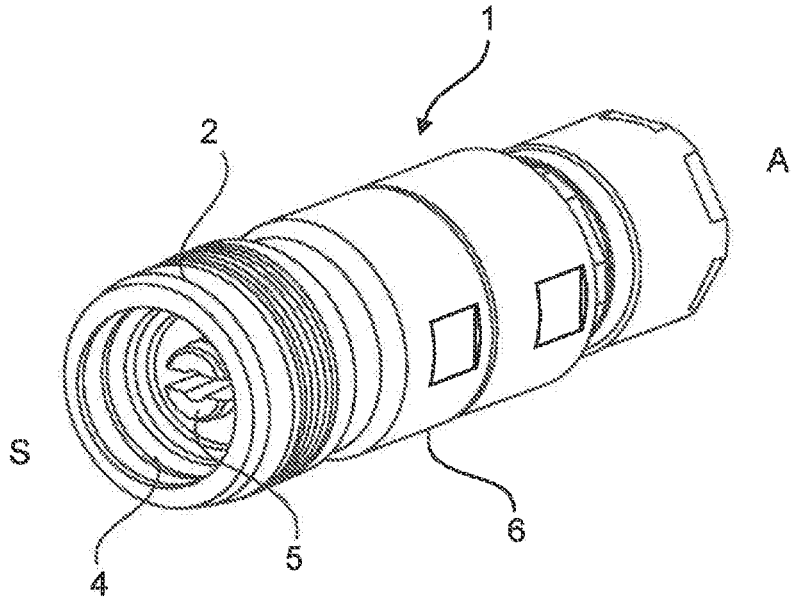
FIG. 1 a perspectival representation of a plug-type connector according to the invention, FIG. 2 a sectional representation of a partial detail of FIG. 1, FIG. 3 a sectional representation of a partial detail of FIG. 1.

FIG. 1 shows a perspectival representation of a plug-type connector 1 according to the invention. The plug-type connector 1 exhibits a plug-in side S and a connection side A. The plug-in side S is arranged here on the left side of the image; the connection side A on the right side of the image. The plug-in side S serves for contacting the plug-type connector 1 with a corresponding mating connector. The connection side A, on the other hand, serves for connecting the plug-type connector 1 to a conductor.

The plug-type connector 1—here, more precisely, a round plug-type connector—consists of a housing 6 and a contact element 5 received in the housing 6. Since this plug-type connector 1 is a plug-type connector according to the push/pull principle, it exhibits, in addition, a union sleeve 2 and a locking ring 4.

Figure 2:
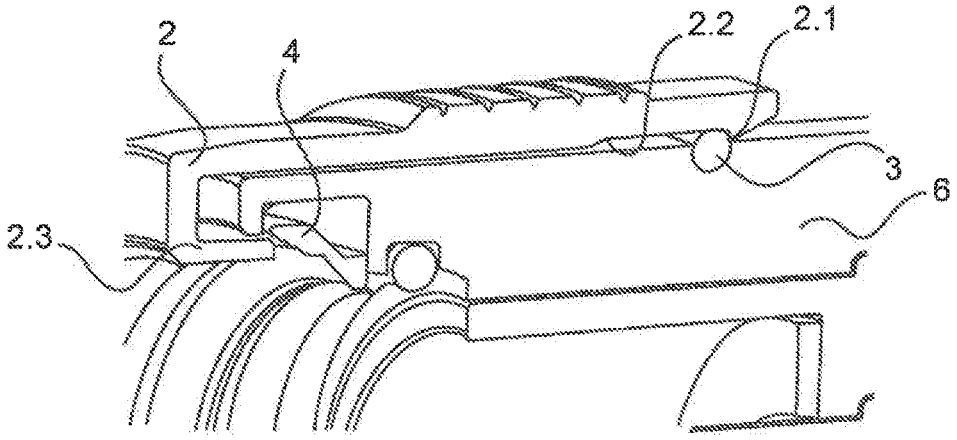

The union sleeve 2 and the locking ring 4 are each arranged on the plug-in side S. The union sleeve 2 is movably arranged on the outside of the housing 6. Said union sleeve resembles a cylinder in shape and is provided with ridges on the side facing away from the housing 6, for better gripping for the user. The union sleeve 2 exhibits, in addition, a detent-hook-like molded-on part on the side facing toward the plug-in side S. Said molded-on part will be designated in the following as a detent hook 2.3 and is shown in FIG. 2. The detent hook 2.3 has been designed in such a way that in the course of an axial movement of the union sleeve 2 it acts on the locking ring 4 and is able to widen the latter.

The locking ring 4 is received within the union sleeve 2 ahead of the housing 6 and is arranged there in a circumferential recess with space for widening.

On the connection side A, the plug-type connector also exhibits a cable fastening—here, a threaded cable gland—for fixing a received conductor.

FIG. 2 shows a detail of a representation of a section through FIG. 1. The detail relates to the plug-in side S in the region of the union sleeve 2.

In this representation, the position of the O-ring 3 and the mode of action of the union sleeve 2, as well as the arrangement of the housing 6, the O-ring 3, the locking ring 4 and the union sleeve 2 can be discerned.

The union sleeve 2 is arranged on the outside of the housing 6. Said sleeve exhibits a circumferential detent hook 2.3 on the plug-in side S, which is able to act on the locking ring 4.

In the direction of the connection side A, on the other hand, the union sleeve 2 exhibits a circumferential groove 2.2 and a circumferential undercut 2.1. The groove 2.2 and the undercut 2.1 are arranged on the side of the union sleeve 2 facing toward the housing 6. The groove 2.2 and the undercut 2.1 form a common region of movement of the union sleeve 2. The undercut 2.1 forms the end facing toward the connection side A, and the groove 2.2 forms the end of the region facing toward the plug-in side S.

In this region, the O-ring 3, over which the union sleeve 2 is displaceable in a sliding manner, is fixed to the housing 6. If the O-ring 3 is abutting the undercut 2.1, as shown in FIG. 2, the union sleeve 2 is then in a relaxed position and is not acting on the locking ring 4. In this position, a received mating connector is held securely.

If the O-ring 3 is abutting the groove 2.2, not shown here, the union sleeve 2 is then in a tensioned position and acts on the locking ring 4 by widening it by means of the detent hook 2.3. In the process, the locking ring 4 plunges more deeply into its recess in the housing 6 and in this way increases the diameter at this point. In this position, a received mating connector can be released, or a different mating connector can be inserted.

In order to move the union sleeve 2 from the relaxed position into the tensioned position, an axial movement of the union sleeve from the plug-in side S in the direction of the connection side A is necessary. The movement in the opposite direction—that is to say, from the tensioned position into the relaxed position—takes place by itself by virtue of the relief being striven for by reason of the acting restoring force of the locking ring 4. However, said movement can also be carried out actively, by the union sleeve 2 being actively moved from the connection side A in the direction of the plug-in side S.

Figure 3:
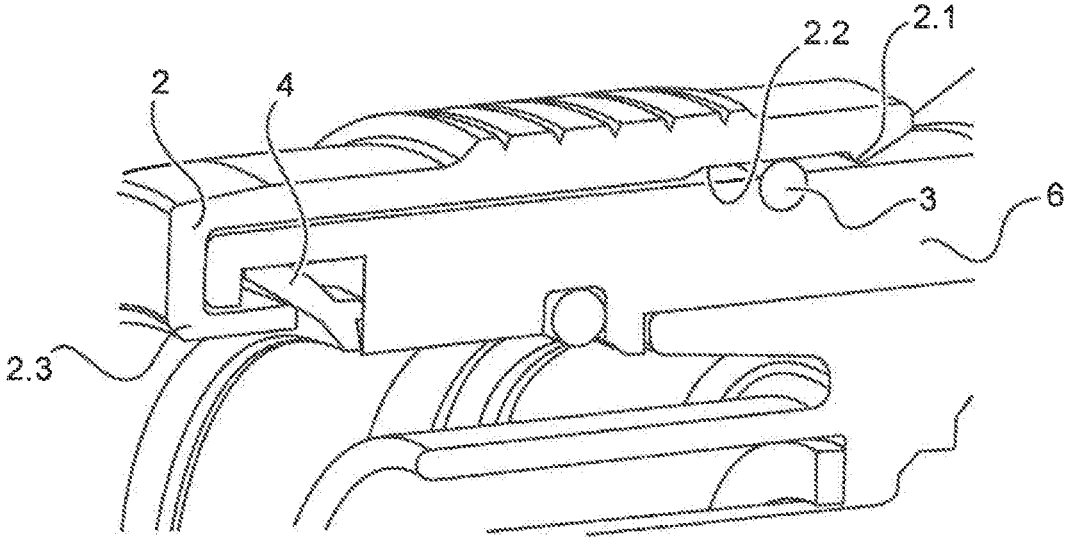

FIG. 3 shows the same detail of a representation of a section through FIG. 1 and also FIG. 2. The detail relates to the plug-in side S in the region of the union sleeve 2.

If the O-ring 3 is abutting the undercut 2.1, as shown in FIG. 2, the union sleeve 2 is then in a relaxed position and is not acting on the locking ring 4. In this position, a received mating connector is held securely.

The tensioned position of the O-ring 3 is shown in FIG. 3. Here the O-ring 3 is closely abutting the groove 2.2. The union sleeve 2 is in a tensioned position and acts on the locking ring 4 by widening it by means of the detent hook 2.3. In the process, the locking ring 4 plunges more deeply into its recess in the housing 6 and in this way increases the diameter at this point. In this position, a received mating connector can be released, or a different mating connector can be inserted.

In order to move the union sleeve 2 from the relaxed position, FIG. 2, into the tensioned position, FIG. 3, an axial movement of the union sleeve from the plug-in side S in the direction of the connection side A is necessary. The movement in the opposite direction—that is to say, from the tensioned position into the relaxed position—takes place by itself by virtue of the relief being striven for by reason of the acting restoring force of the locking ring 4. However, said movement can also be carried out actively, by the union sleeve 2 being actively moved from the connection side A in the direction of the plug-in side S.

Even though various aspects or features of the invention are shown in the figures in each instance in combination, for a person skilled in the art it is evident—unless otherwise stated—that the combinations represented and discussed are not the only ones possible. In particular, units or feature complexes corresponding to one another from differing embodiments can be interchanged with one another.

LIST OF REFERENCE SYMBOLS

1 plug-type connector
2 union sleeve

2.1 undercut
2.2 groove
2.3 detent hook
3 O-ring
4 locking ring
5 contact element
6 housing
A connection side
S plug-in side

The invention claimed is:

1. A plug-type connector having a housing, a locking ring and a union sleeve, wherein the locking ring is split, by virtue of which the locking ring is compressible and dilatable, wherein the housing exhibits a plug-in side and a connection side, wherein the union sleeve and the locking ring are each arranged on the plug-in side, wherein the union sleeve is arranged so as to be axially mobile, wherein the union sleeve exhibits a circumferential undercut and a circumferential groove adjoining the undercut, wherein the undercut is arranged on the union sleeve in the direction of the connection side, wherein the groove is arranged on the union sleeve in the direction of the plug-in side, wherein the undercut and the groove form a common region of movement on the side of the union sleeve facing toward the housing, and wherein the plug-type connector includes a seal in the form of an O-ring, wherein the O-ring is arranged on the housing of the plug-type connector, the union sleeve is displaceable over the O-ring in a sliding manner in the region of the circumferential groove and the circumferential undercut between a relaxed position and a tensioned position, wherein in the relaxed position the union sleeve is not acting on the locking ring, wherein in the tensioned position the union sleeve acts on the locking ring.

2. The plug-type connector as claimed in claim 1, wherein the locking ring is dilatable by the axial movement of the union sleeve.

* * * * *